US009219319B2

(12) United States Patent
Chen

(10) Patent No.: US 9,219,319 B2
(45) Date of Patent: Dec. 22, 2015

(54) SATA CONNECTOR AND ELECTRICAL CONNECTOR ASSEMBLY THEREOF

(71) Applicant: BING XU PRECISION CO., LTD., New Taipei (TW)

(72) Inventor: Chih-jung Chen, New Taipei (TW)

(73) Assignee: BING XU PRECISION CO., LTD., New Taipei (TW)

( * ) Notice: Subject to any disclaimer, the term of this patent is extended or adjusted under 35 U.S.C. 154(b) by 0 days.

(21) Appl. No.: 14/315,683

(22) Filed: Jun. 26, 2014

(65) Prior Publication Data

US 2015/0024633 A1 Jan. 22, 2015

Related U.S. Application Data

(60) Provisional application No. 61/857,042, filed on Jul. 22, 2013.

(51) Int. Cl.

| | |
|---|---|
| ***H01R 12/79*** | (2011.01) |
| ***H01R 12/59*** | (2011.01) |
| *H01R 12/77* | (2011.01) |

(52) U.S. Cl.
CPC ..... *H01R 12/592* (2013.01); *H01R 12/772* (2013.01)

(58) Field of Classification Search
CPC ..... H01R 12/79; H01R 23/662; H01R 12/592
See application file for complete search history.

(56) References Cited

U.S. PATENT DOCUMENTS

| | | | | |
|---|---|---|---|---|
| 4,824,384 | A * | 4/1989 | Nicholas et al. | 439/108 |
| 6,213,802 | B1 * | 4/2001 | Wu et al. | 439/260 |
| 6,273,753 | B1 * | 8/2001 | Ko | 439/579 |
| 7,467,969 | B2 * | 12/2008 | Liu et al. | 439/493 |
| 7,553,191 | B2 * | 6/2009 | Su et al. | 439/637 |
| 7,803,009 | B2 * | 9/2010 | Su et al. | 439/492 |
| 7,914,304 | B2 * | 3/2011 | Cartier et al. | 439/83 |
| 8,277,258 | B1 * | 10/2012 | Huang et al. | 439/660 |
| 8,602,812 | B2 * | 12/2013 | Ohsaka | 439/497 |
| 8,672,689 | B2 * | 3/2014 | Tseng | 439/76.1 |
| 2003/0181094 | A1 * | 9/2003 | Wang et al. | 439/492 |
| 2005/0272303 | A1 * | 12/2005 | Wu | 439/499 |
| 2006/0079119 | A1 * | 4/2006 | Wu | 439/492 |
| 2009/0130896 | A1 * | 5/2009 | Cheng et al. | 439/495 |
| 2009/0233480 | A1 * | 9/2009 | Feldman et al. | 439/497 |
| 2009/0311887 | A1 * | 12/2009 | Zhu | 439/67 |
| 2010/0190373 | A1 * | 7/2010 | Yeh | 439/499 |
| 2011/0189884 | A1 * | 8/2011 | Su et al. | 439/404 |
| 2013/0303018 | A1 * | 11/2013 | Tseng et al. | 439/492 |

* cited by examiner

*Primary Examiner* — Gary Paumen
(74) *Attorney, Agent, or Firm* — Hauptman & Ham, LLP

(57) ABSTRACT

A SATA connector including an insulative housing and a plurality of terminals are provided. The insulative housing has a plurality of slots into which external terminals are inserted, and the slots run through the insulative housing from a front side to a rear side. The terminals include a plurality of mating portions inserted into the slots and a plurality of extending portions led from the rear side of the insulative housing. Ends of the extending portions are collected on the rear side of the insulative housing to form a plurality of contact pads for electrically coupling to a flexible flat cable. An electrical connector assembly including the above-mentioned SATA connector is further provided.

17 Claims, 13 Drawing Sheets

4

SATA CONNECTOR AND ELECTRICAL CONNECTOR ASSEMBLY THEREOF

CROSS-REFERENCED TO RELATED APPLICATIONS

This application claims priority to U.S. Provisional Patent Application Ser. No. 61/857,042 filed on Jul. 22, 2013.

FIELD OF THE INVENTION

The present invention relates to an electrical connector, and especially to a Serial ATA (SATA) connector and an electrical connector assembly using a flexible flat cable.

BACKGROUND OF THE INVENTION

At present, the application of flexible flat cables (FFC) is more widely used.

Except for the application for the electrical connector with a Low-Voltage Differential Signal (LVDS) interface definition, the FFC further can be used for the electrical connector with a Serial Advanced Technology Attachment (SATA) interface definition. Taiwan Utility Model Patent Publication No. M453260 disclosed a SATA connector, which includes an insulative housing, conductive terminals received in the insulative housing, a printed circuit board (PCB) electrically coupled to the conductive terminals, and a flexible flat cable electrically coupled to the conductive terminals via the PCB.

In existing technologies, since the connection between the conductive terminals and the flexible flat cable is realized by the PCB, there are complex processes of welding the conductive terminals to the PCB and then welding the flexible flat cable to the PCB. In addition, the signals being transmitted via the multiple paths of the PCB will cause signal attenuation. Moreover, the size of the SATA connector cannot be reduced.

Consequently, there is a significant need to provide a new SATA connector and an electrical connector assembly for solving the above-mentioned technical problems.

SUMMARY OF THE INVENTION

As to the above-mentioned problems, an objective of the present invention is to provide a SATA connector and an electrical connector assembly, in which the terminals are directly electrically coupled to the flexible flat cable, thereby achieving the advantages of being a simple process, low cost, avoiding signal attenuation, and decreased size.

To achieve the foregoing objective, the SATA connector provided by the present invention includes an insulative housing and a plurality of terminals. The insulative housing has a plurality of slots into which external terminals are inserted, and the slots run through the insulative housing from a front side to a rear side. The terminals include a plurality of mating portions inserted into the slots and a plurality of extending portions led from the rear side of the insulative housing. The ends of the extending portions are collected on the rear side of the insulative housing to form a plurality of contact pads for electrically coupling to a flexible flat cable.

In one preferred embodiment, the slots in the insulative housing are divided into a first slot group and a second slot group, both of which are separated by a predetermined distance, and the ends of the extending portions are collected on the rear side of the insulative housing and positioned between the first slot group and the second slot group.

In one preferred embodiment, the mating portions are coupled to the extending portions via a plurality of bending portions.

In one preferred embodiment, the contact pads have metal soldering material thereon. In another preferred embodiment, the contact pads have bends or bumps.

In one preferred embodiment, the terminals include a plurality of ground terminals, power terminals, and signal terminals. The signal terminals are divided into a first pair of signal terminals and a second pair of signal terminals. Two extending portions corresponding to the first pair of signal terminals have identical lengths, and two extending portions corresponding to the second pair of signal terminals have identical lengths.

The electrical connector assembly provided by the present invention includes an insulative housing, a plurality of terminals, a flexible flat cable, and a cover. The insulative housing having a plurality of slots into which external terminals are inserted, and the slots run through the insulative housing from a front side to a rear side. The terminals include a plurality of mating portions inserted into the slots and a plurality of extending portions led from the rear side of the insulative housing. The ends of the extending portions are collected on the rear side of the insulative housing to form a plurality of contact pads. The flexible flat cable has a conductor at an end portion of the flexible flat cable, and the conductor is electrically coupled to the contact pads. The end portion of the flexible flat cable is bent to form at least one overlapping portion on the rear side of the insulative housing. The cover is mounted on the rear side of the insulative housing and clamps the end portion of the flexible flat cable and the overlapping portion.

In one preferred embodiment, the cover has an elongated opening from which the flexible flat cable is led. In addition, the flexible flat cable has a U-shaped bend in the contact pads and an L-shaped bend in the elongated opening.

In one preferred embodiment, the contact pads and the conductor of the end portion of the flexible flat cable are welded together.

In another preferred embodiment, the contact pads have bends or bumps for contacting the conductor of the end portion of the flexible flat cable.

The electrical connector assembly provided by the present invention includes an insulative housing, a plurality of terminals, and a flexible flat cable. The insulative housing having a plurality of slots into which external terminals are inserted, and the slots run through the insulative housing from a front side to a rear side. The insulative housing has a through slot which is parallel to the rear side. The terminals include a plurality of mating portions inserted into the slots and a plurality of extending portions led from the rear side of the insulative housing. The ends of the extending portions are collected on the rear side of the insulative housing to form a plurality of contact pads. The end portion of the flexible flat cable is wound around the through slot, and the conductor of the end portion of the flexible flat cable is electrically coupled to the contact pads.

In one preferred embodiment, the flexible flat cable is led from an edge of the rear side of the insulative housing.

In one preferred embodiment, the electrical connector assembly further includes a cover, which is mounted on the rear side of the insulative housing.

In comparison with the prior art, the terminals of the present invention are directly electrically coupled to the flexible flat cable, thereby achieving the advantages of being a simple processes, low cost, avoiding signal attenuation, and decreased size.

It is to be understood that both the foregoing general description and the following detailed description of the present invention are exemplary and explanatory and are intended to provide further explanation of the invention as claimed.

DETAILED DESCRIPTION OF THE PREFERRED EMBODIMENTS

Figure 1:
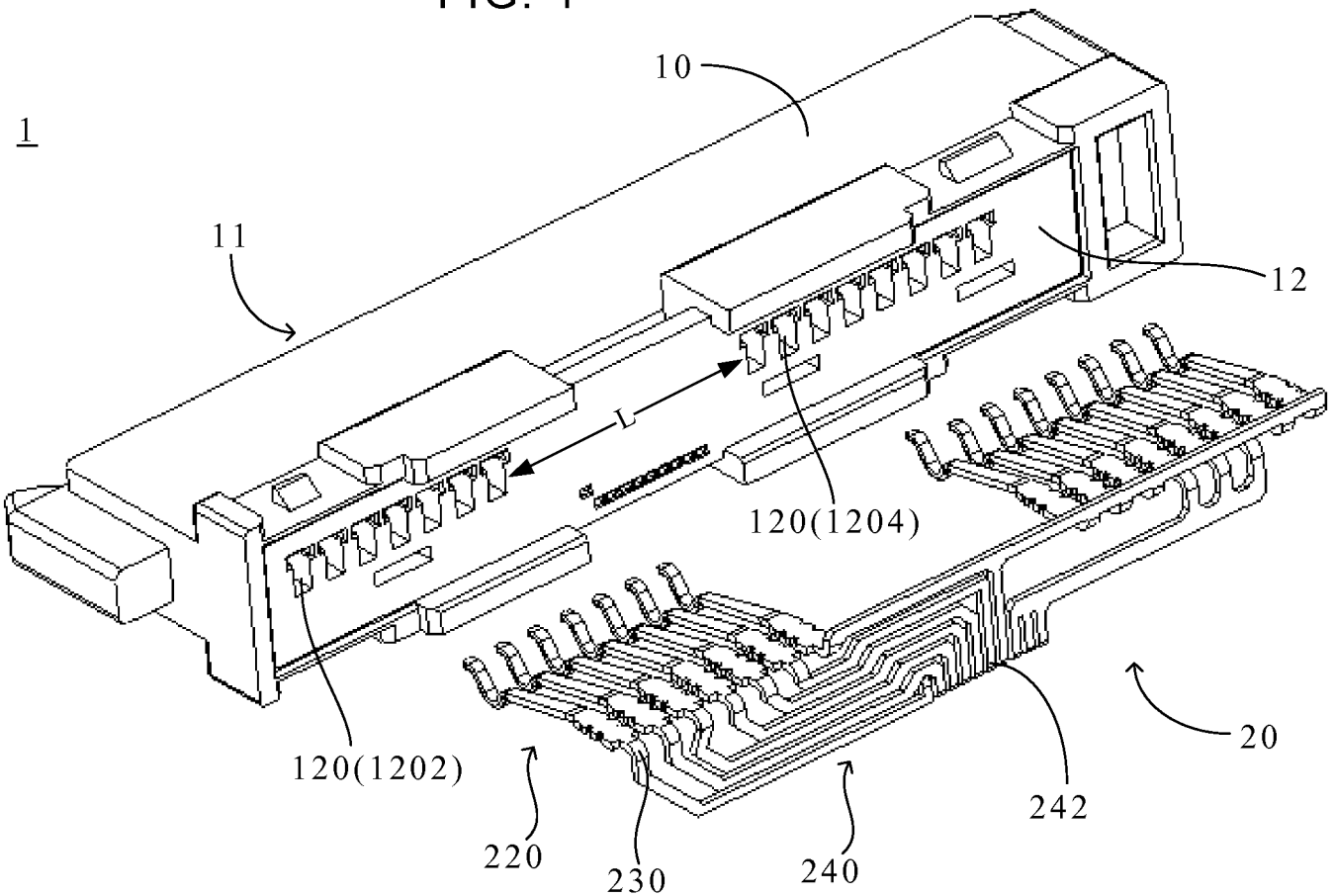
FIG. 1 is an exploded perspective view illustrating a SATA connector according to one preferred embodiment of the present invention.

The present invention will now be described in detail with reference to a few preferred embodiments thereof as illustrated in the accompanying drawings. The same reference numerals refer to the same parts or like parts throughout the various figures.

FIG. 1 is an exploded perspective view illustrating a SATA connector according to one preferred embodiment of the present invention. The SATA connector 1 of the embodiment includes an insulative housing 10 and a plurality of terminals 20. The insulative housing 10 has a plurality of slots 120 into which external terminals (not shown) are inserted, and the slots 120 run through the insulative housing 10 from a front side 11 to a rear side 12. The external terminals herein are inserted from the front side 11 of the insulative housing 10. Specifically, the slots 120 in the insulative housing 10 are divided into a first slot group 1202 and a second slot group 1204. The first slot group 1202 and the second slot group 1204 are separated by a predetermined distance L.

The terminals 20 include a plurality of mating portions 220 that are inserted into the slots 120 and a plurality of extending portions 240 that are led from the rear side 12 of the insulative housing 10. Specifically, the mating portions 220 are coupled to the extending portions 240 via a plurality of bending portions 230. The ends of the extending portions 240 are collected on the rear side 12 of the insulative housing 10 to form a plurality of contact pads 242 for electrically coupling to a flexible flat cable (not shown). In the embodiment, the ends of the extending portions 240 are collected on the rear side 12 of the insulative housing 10 and between the first slot group 1202 and the second slot group 1204.

Figure 2:
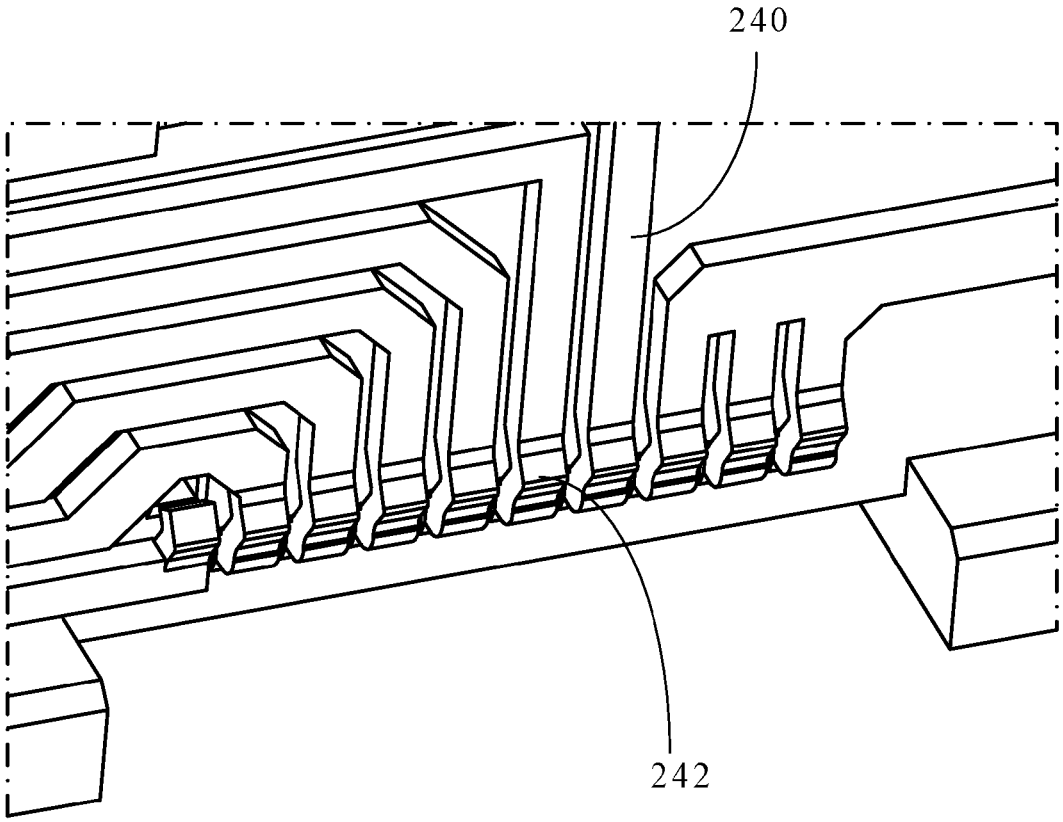
FIG. 2 is a partial enlarged view illustrating the ends of the extending portion according to another embodiment.

In the embodiment, the contact pads 242 have metal soldering material such as tin to be welded to the conductor of the flexible flat cable. FIG. 2 is a partial enlarged view illustrating the ends of the extending portion according to another embodiment. In other embodiments, the contact pads 242 have bends or bumps.

Figure 3:
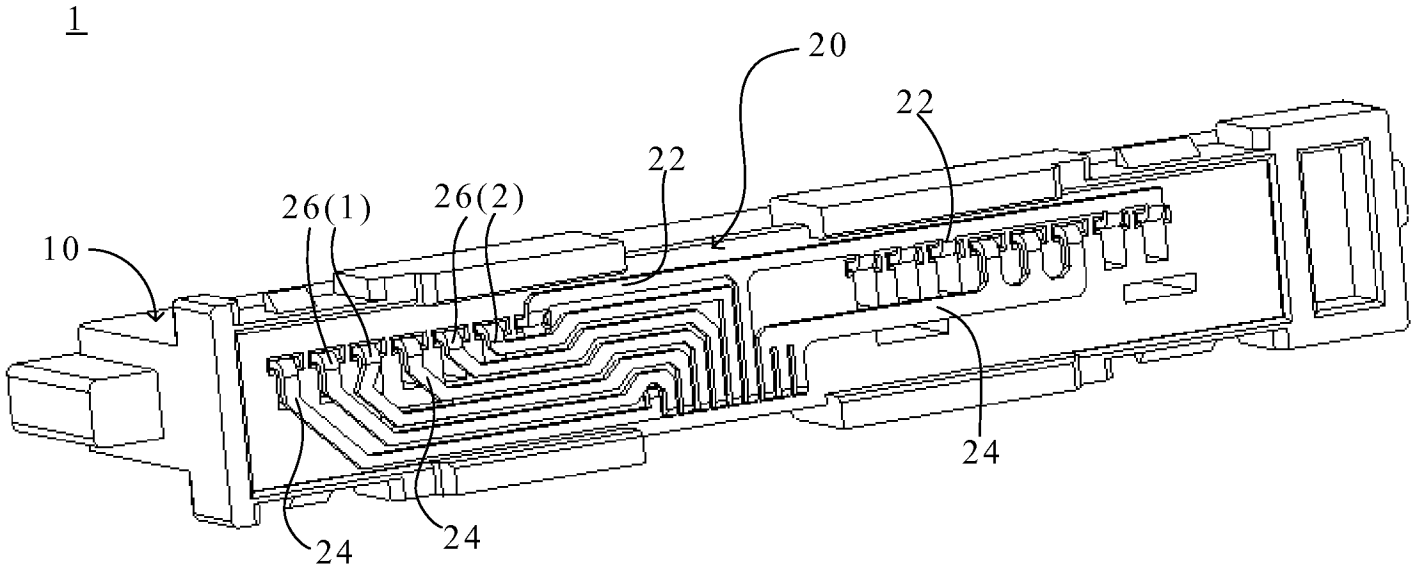
FIG. 3 is a combined view of the SATA connector of FIG. 1.

Referring to FIG. 1 and FIG. 3, FIG. 3 is a combined view of the SATA connector of FIG. 1. The terminals 20 include a plurality of ground terminals 22, power terminals 24, and signal terminals 26. As shown in FIG. 3, the ground terminals 22 may be formed by multiple mating portions 220 coupling to one extending portion 240. In other embodiments, the ground terminals 22 may be formed by one mating portion 220 coupling to one extending portion 240. As shown in FIG. 3, the power terminals 24 on the right side have three mating portions 220 which are collected as one extending portion 240 and then branched out into three contact pads 242. The signal terminals 26 are divided into a first pair of signal terminals 26(1) and a second pair of signal terminals 26(2). The two extending portions 240 that correspond to the first pair of signal terminals 26(1) have identical lengths, and the two extending portions 240 that correspond to the second pair of signal terminals 26(2) also have identical lengths, so as to achieve the same impedance of the signal transmission.

The electrical connector assembly employing the above-mentioned SATA connector 1 will be explained in the following description.

The descriptions of the same elements which have been explained above will not be have further detail provided herein.

Figure 4:
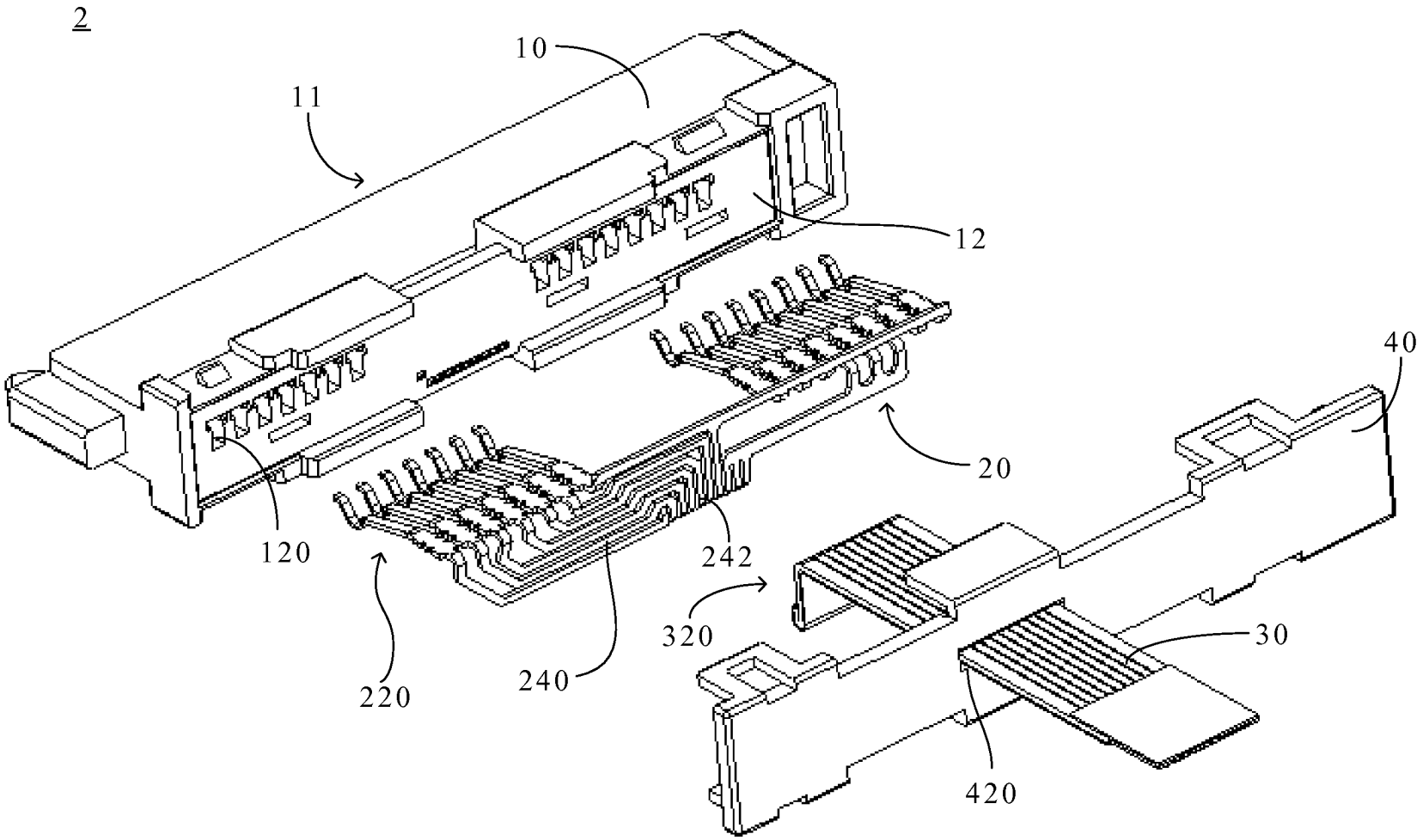
FIG. 4 is an exploded perspective view illustrating an electrical connector assembly according to a first embodiment of the present invention.

FIG. 4 is an exploded perspective view illustrating an electrical connector assembly according to a first embodiment of the present invention. The electrical connector assembly 2 of the embodiment includes an insulative housing 10, a plurality of terminals 20, a flexible flat cable 30, and a cover 40.

The insulative housing 10 has the plurality of slots 120 into which the external terminals are inserted, and the slots 120 run through the insulative housing 10 from the front side 11 to the rear side 12. The terminals 20 include a plurality of mating portions 220 inserted into the slots 120 and a plurality of extending portions 240 led from the rear side 12 of the insulative housing 10. The ends of the extending portions 240 are collected on the rear side 12 of the insulative housing 10 to form the contact pads 242.

Figure 5:
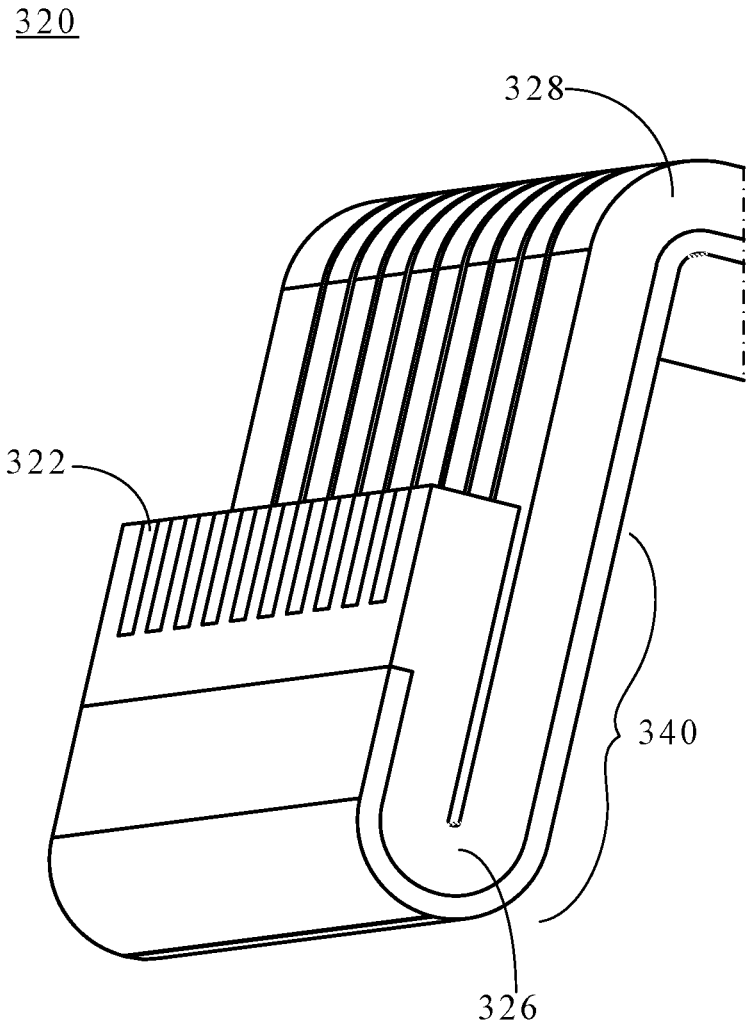
FIG. 5 is a partial perspective view illustrating the end portion of the flexible flat cable according to the first embodiment.

Referring to FIG. 4 and FIG. 5, FIG. 5 is a partial perspective view illustrating the end portion of the flexible flat cable according to the first embodiment. The conductor 322 of the end portion 320 of the flexible flat cable 30 is electrically coupled to the contact pads 242, and the end portion 320 of the flexible flat cable 30 is bent to form at least one overlapping portion 340 on the rear side 12 of the insulative housing 10. The cover 40 is mounted on the rear side 12 of the insulative housing 10 and clamps the end portion 320 of the flexible flat cable 30 and the overlapping portion 340 to strengthen the coupling strength of the flexible flat cable 30. More specifically, the cover 40 has an elongated opening 420 from which the flexible flat cable 30 is led. In addition, the flexible flat cable 30 has a U-shaped bend 326 in the contact pads 242 and an L-shaped bend 328 in the elongated opening 420.

In the embodiment, the contact pads 242 and the conductor 322 of the end portion 320 of the flexible flat cable 30 are welded together. However, in other embodiments, the contact pads 242 have bends or bumps for contacting the conductor 322 of the end portion 320 of the flexible flat cable 30.

Figure 6:
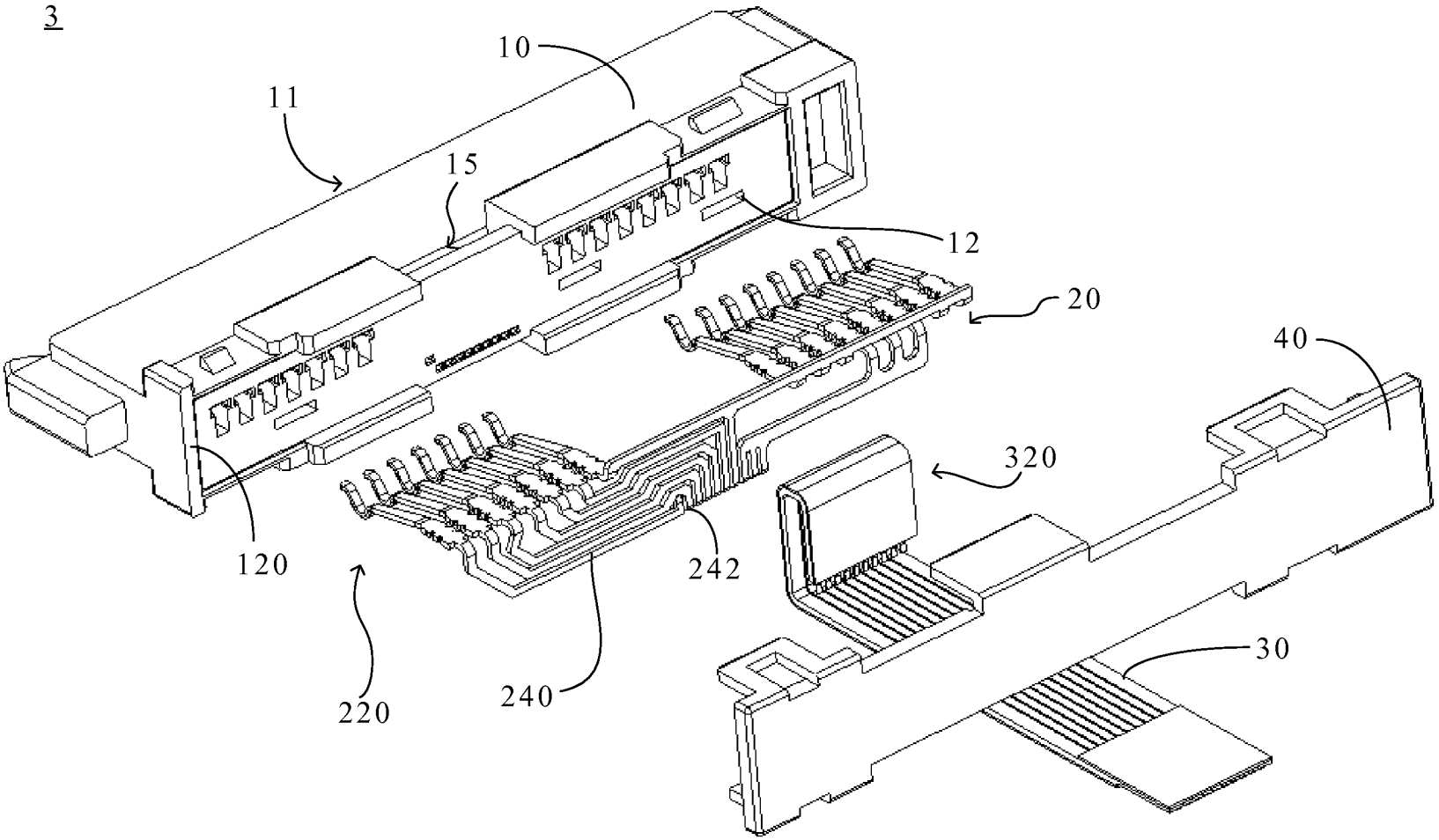
FIG. 6 is an exploded perspective view illustrating an electrical connector assembly according to a second embodiment of the present invention.
Figure 7:
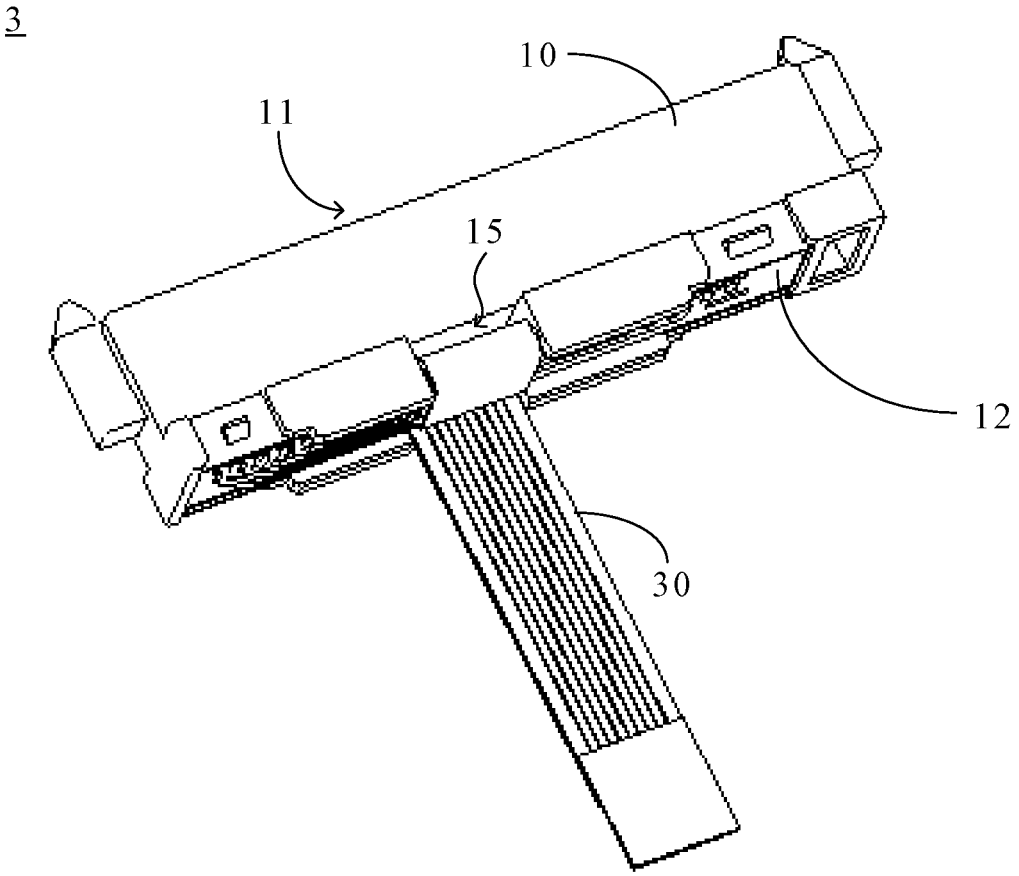
FIG. 7 is a combined view of the SATA connector of FIG. 6.

Referring to FIG. 6 and FIG. 7, FIG. 6 is an exploded perspective view illustrating an electrical connector assembly according to a second embodiment of the present invention, and FIG. 7 is a combined view of the SATA connector of FIG. 6. The electrical connector assembly 3 of the embodiment includes an insulative housing 10, a plurality of terminals 20, a flexible flat cable 30, and a cover 40. The insulative housing 10 has the plurality of slots 120 into which the external terminals are inserted, and the slots 120 run through the insulative housing 10 from the front side 11 to the rear side 12. The insulative housing 10 has a through slot 15 which is parallel to the rear side 12. The terminals 20 include a plurality of mating portions 220 inserted into the slots 120 and a plurality of extending portions 240 led from the rear side 12 of the insulative housing 10. The ends of the extending portions 240 are collected on the rear side 12 of the insulative housing 10 to form the contact pads 242.

Figure 8:
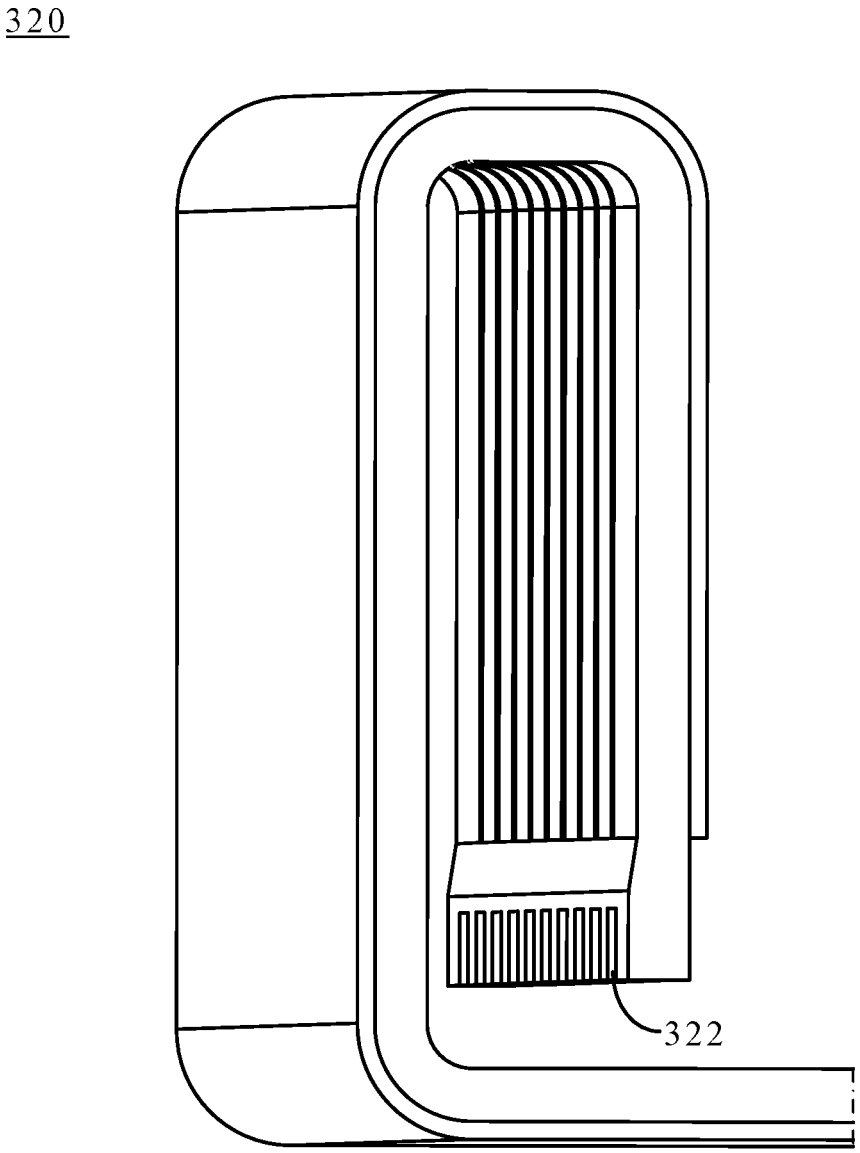
FIG. 8 is a partial perspective view illustrating the end portion of the flexible flat cable according to the second embodiment.

Referring to FIG. 6 to FIG. 8, FIG. 8 is a partial perspective view illustrating the end portion of the flexible flat cable according to the second embodiment. The end portion 320 of the flexible flat cable 30 is wound around the through slot 15, and the conductor 322 of the end portion 320 of the flexible flat cable 30 is electrically coupled to the contact pads 242. It is worth mentioning that the thickness of the end portion 320 of the flexible flat cable 30 at the conductor 322 is slightly larger than that of the flexible flat cable 30, so the conductor 322 can be coupled to the contact pads 242 by a contact manner without the welding process. As shown in FIG. 6 and FIG. 7, the flexible flat cable 30 is led from an edge of the rear side 12 of the insulative housing 10, and the cover 40 is mounted on the rear side 12 of the insulative housing 10 to enhance the coupling strength of the flexible flat cable 30. Furthermore, the cover 40 has a protrusion (not shown) on the side facing the contact pads 242. The protrusion can be utilized to strengthen the coupling between the conductor 322 of the flexible flat cable 30 and the contact pads 242.

Figure 9:
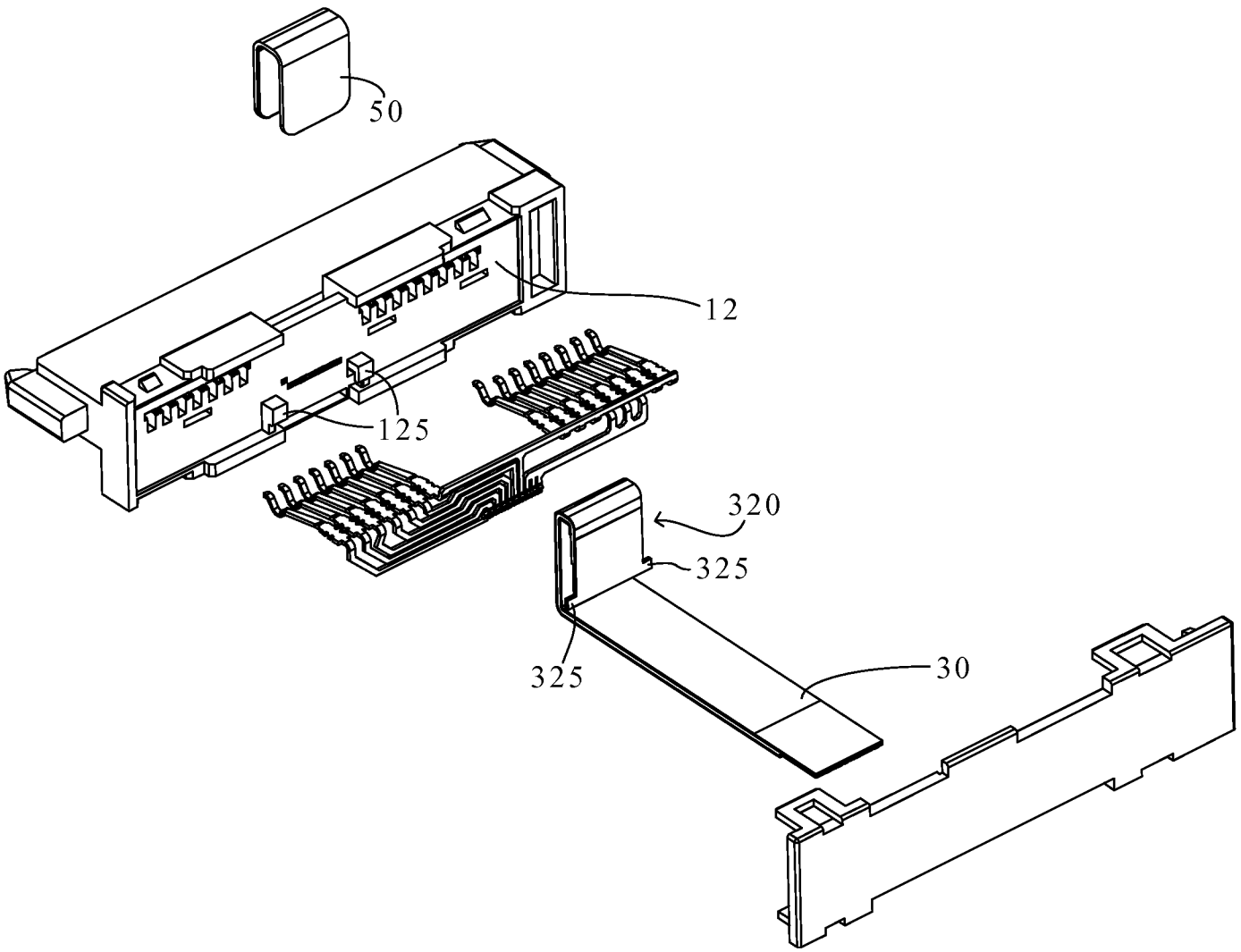
FIG. 9 is an exploded perspective view illustrating an electrical connector assembly according to a third embodiment of the present invention.
Figure 10:
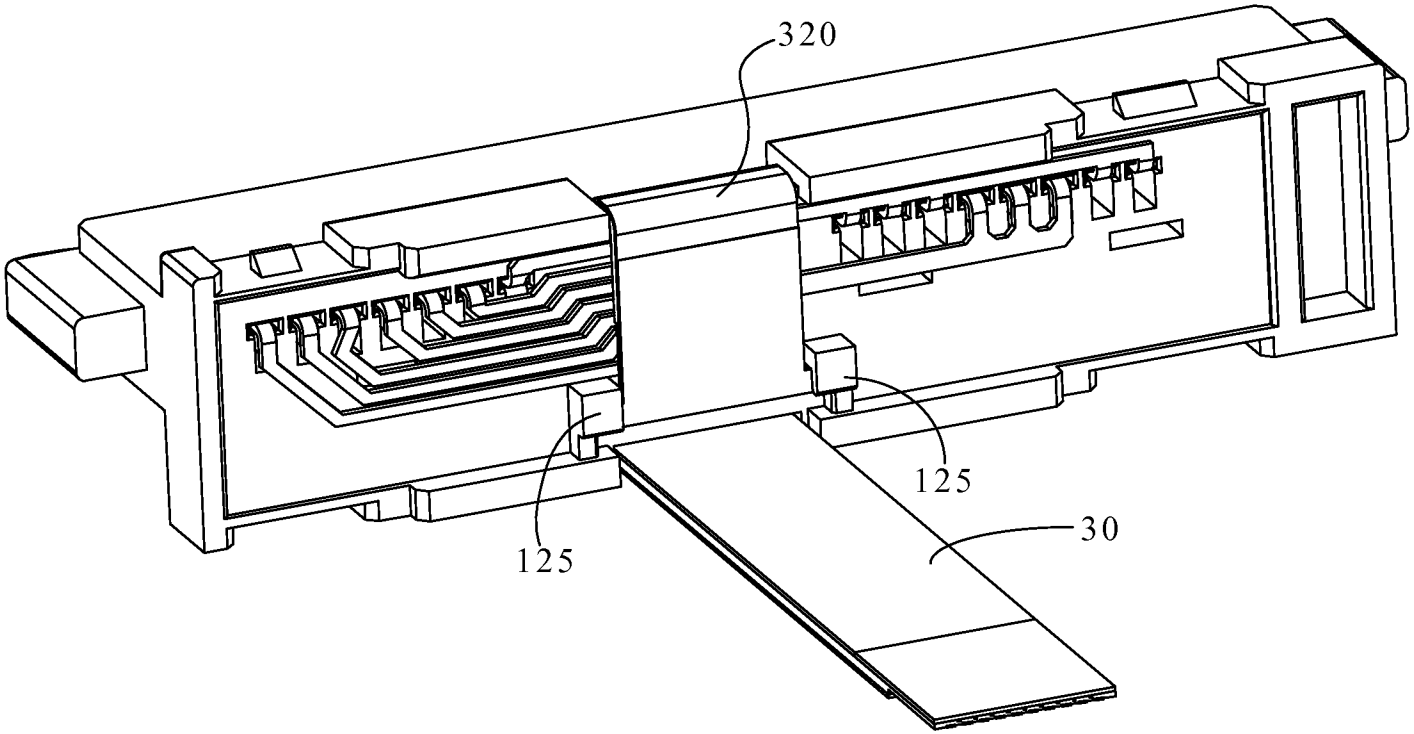
FIG. 10 and FIG. 11 are partial perspective views illustrating the electrical connector assembly of the third embodiment.
Figure 11:
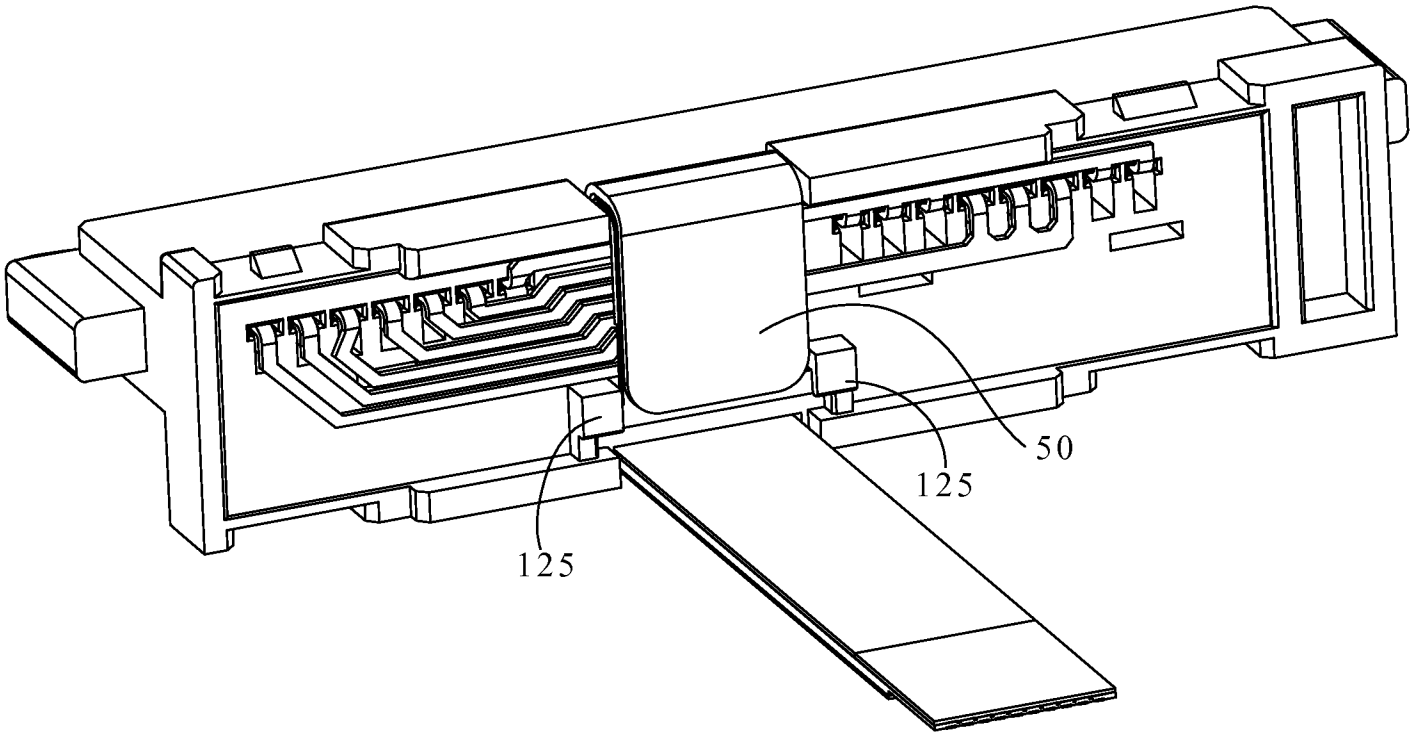

Referring to FIG. 9 to FIG. 11, FIG. 9 is an exploded perspective view illustrating an electrical connector assembly according to a third embodiment of the present invention, and FIG. 10 and FIG. 11 are partial perspective views illustrating the electrical connector assembly of the third embodiment. The difference between the electrical connector assembly 4 of the third embodiment and the electrical connector assembly 3 of the second embodiment lies in: the electrical connector assembly 4 further includes a metal clip 50. The metal clip 50 is utilized to clamp the end portion 320 of the flexible flat cable 30 for securing the electrical coupling between the conductor 322 of flexible flat cable 30 and the contact pads 242.

Moreover, the end portion 320 of the flexible flat cable 30 has two protrusions 325 at both sides thereof. The insulative housing 10 has two stopping portions 125, which are protrudingly formed on the rear side 12 and correspond to the two protrusions 325. In the assembling process, the two protrusions 325 of the flexible flat cable 30 are engaged in the two stopping portions 125, thereby enhancing the fastness between the flexible flat cable 30 and the insulative housing 10.

Figure 12:
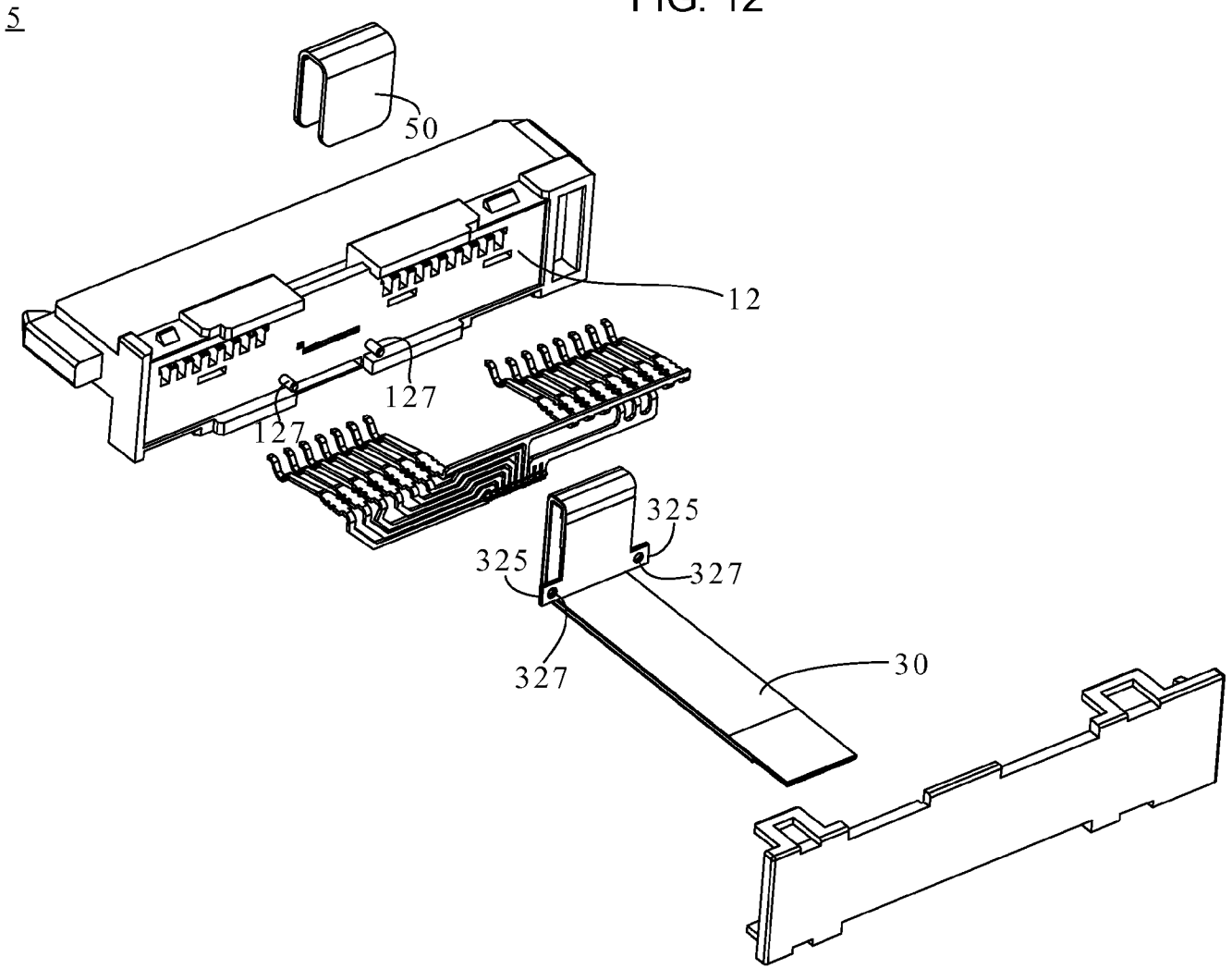
FIG. 12 is an exploded perspective view illustrating an electrical connector assembly according to a fourth embodiment of the present invention.
Figure 13:
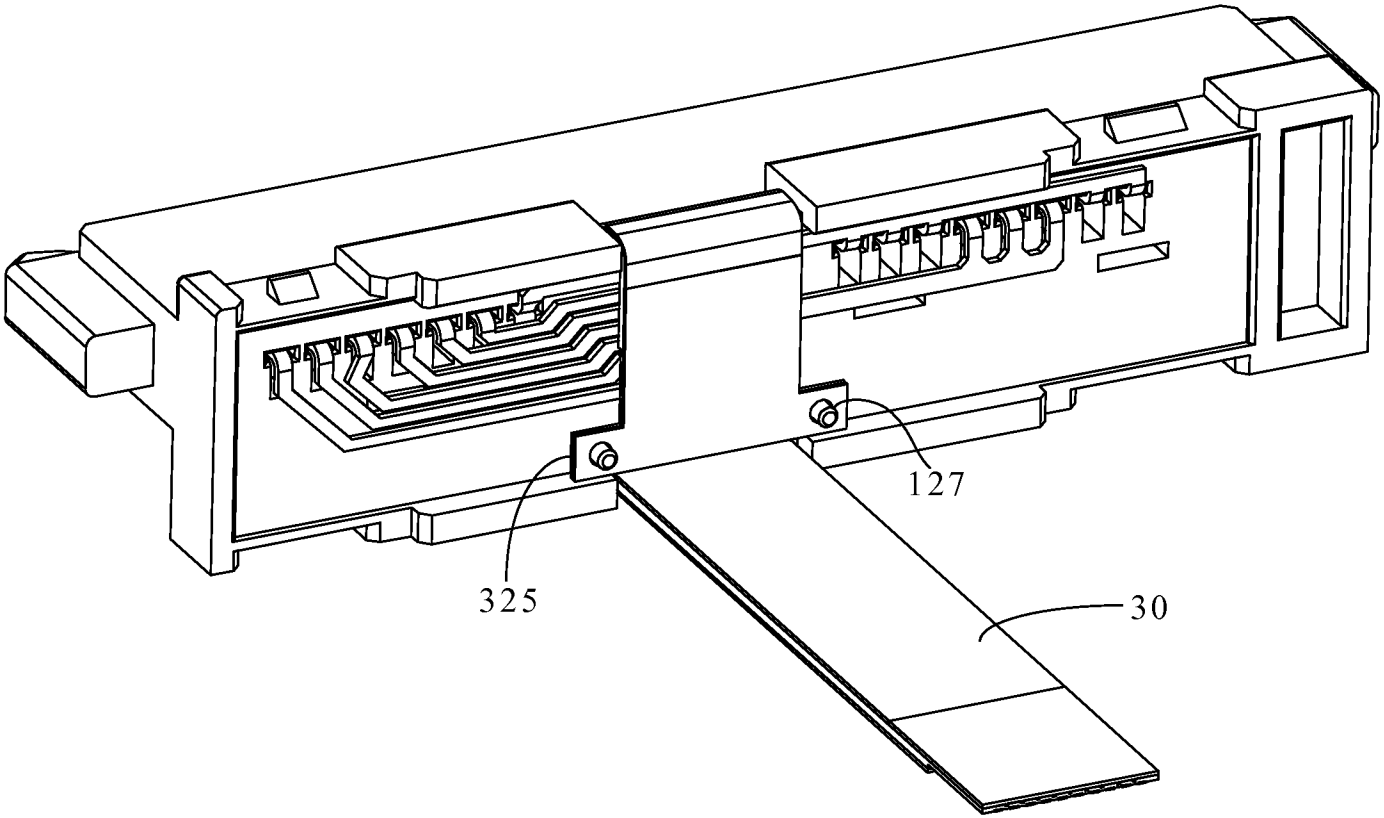
FIG. 13 is a partial perspective view illustrating the electrical connector assembly of the fourth embodiment.

Referring to FIG. 12 to FIG. 13, FIG. 12 is an exploded perspective view illustrating an electrical connector assembly according to a fourth embodiment of the present invention, and FIG. 13 is a partial perspective view illustrating the electrical connector assembly of the fourth embodiment. The difference between the electrical connector assembly 5 of the fourth embodiment and the electrical connector assembly 4 of the third embodiment lies in: each of the two protrusions 325 of the flexible flat cable 30 has a through hole 327. In addition, the insulative housing 10 has two position pins 127, which are protrudingly formed on the rear side 12 and correspond to the two through holes 327. In the assembling process, the two position pins 127 are inserted into the through holes 327 of the flexible flat cable 30, thereby enhancing the fastness between the flexible flat cable 30 and the insulative housing 10.

In summary, the terminals 20 of the present invention are directly electrically coupled to the flexible flat cable 30 without the transmission of the PCB, thereby achieving the advantages of being a simple process, low cost, avoiding signal attenuation, and decreased size.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and scope of the present invention are within the scope as defined in the appended claims.

What is claimed is:

1. A SATA connector, comprising:

an insulative housing having a plurality of slots into which external terminals are inserted, the slots running through the insulative housing from a front side to a rear side; and a plurality of terminals comprising a plurality of mating portions inserted into the slots and a plurality of extending portions led from the rear side of the insulative housing, ends of the extending portions being collected on the rear side of the insulative housing to form a plurality of contact pads for electrically coupling to a flexible flat cable, wherein the slots in the insulative housing are divided into a first slot group and a second slot group, both of which are separated by a predetermined distance, and the ends of the extending portions are collected on the rear side of the insulative housing and positioned between the first slot group and the second slot group.

2. A SATA connector, comprising:

an insulative housing having a plurality of slots into which external terminals are inserted, the slots running through the insulative housing from a front side to a rear side; and a plurality of terminals comprising a plurality of mating portions inserted into the slots and a plurality of extending portions led from the rear side of the insulative housing, ends of the extending portions being collected on the rear side of the insulative housing to form a plurality of contact pads for electrically coupling to a flexible flat cable, wherein the mating portions are coupled to the extending portions via a plurality of bending portions.

3. The SATA connector according to claim 2, wherein the contact pads have metal soldering material thereon.

4. The SATA connector according to claim 2, wherein the contact pads have bends or bumps.

5. The SATA connector according to claim 2, wherein the terminals comprise a plurality of ground terminals, power terminals, and signal terminals.

6. The SATA connector according to claim 5, wherein the signal terminals are divided into a first pair of signal terminals and a second pair of signal terminals, and wherein two extending portions corresponding to the first pair of signal terminals have identical lengths, and two extending portions corresponding to the second pair of signal terminals have identical lengths.

7. An electrical connector assembly, comprising:

an insulative housing having a plurality of slots into which external terminals are inserted, the slots running through the insulative housing from a front side to a rear side;

a plurality of terminals comprising a plurality of mating portions inserted into the slots and a plurality of extending portions led from the rear side of the insulative housing, ends of the extending portions being collected on the rear side of the insulative housing to form a plurality of contact pads;

a flexible flat cable having a conductor at an end portion of the flexible flat cable, the conductor electrically coupled to the contact pads, the end portion of the flexible flat cable is bent to form at least one overlapping portion on the rear side of the insulative housing; and a cover mounted on the rear side of the insulative housing and clamping the end portion of the flexible flat cable and the overlapping portion, wherein the cover has an elongated opening from which the flexible flat cable is led, wherein the flexible flat cable has a U-shaped bend in the contact pads and an L-shaped bend in the elongated opening.

8. An electrical connector assembly, comprising:

an insulative housing having a plurality of slots into which external terminals are inserted, the slots running through the insulative housing from a front side to a rear side;

a plurality of terminals comprising a plurality of mating portions inserted into the slots and a plurality of extending portions led from the rear side of the insulative housing, ends of the extending portions being collected on the rear side of the insulative housing to form a plurality of contact pads;

a flexible flat cable having a conductor at an end portion of the flexible flat cable, the conductor electrically coupled to the contact pads, the end portion of the flexible flat cable is bent to form at least one overlapping portion on the rear side of the insulative housing; and a cover mounted on the rear side of the insulative housing and clamping the end portion of the flexible flat cable and the overlapping portion, wherein the slots in the insulative housing are divided into a first slot group and a second slot group, both of which are separated by a predetermined distance, and the ends of the extending portions are collected on the rear side of the insulative housing and positioned between the first slot group and the second slot group.

9. An electrical connector assembly, comprising:

an insulative housing having a plurality of slots into which external terminals are inserted, the slots running through the insulative housing from a front side to a rear side;

a plurality of terminals comprising a plurality of mating portions inserted into the slots and a plurality of extending portions led from the rear side of the insulative housing, ends of the extending portions being collected on the rear side of the insulative housing to form a plurality of contact pads, wherein the mating portions are coupled to the extending portions via a plurality of bending portions;

a flexible flat cable having a conductor at an end portion of the flexible flat cable, the conductor electrically coupled to the contact pads, the end portion of the flexible flat cable is bent to form at least one overlapping portion on the rear side of the insulative housing; and a cover mounted on the rear side of the insulative housing and clamping the end portion of the flexible flat cable and the overlapping portion.

10. The electrical connector assembly according to claim 9, wherein the contact pads have bends or bumps for contacting the conductor of the end portion of the flexible flat cable.

11. An electrical connector assembly, comprising:

an insulative housing having a plurality of slots into which external terminals are inserted, the slots running through the insulative housing from a front side to a rear side, wherein the insulative housing has a through slot parallel to the rear side;

a plurality of terminals comprising a plurality of mating portions inserted into the slots and a plurality of extending portions led from the rear side of the insulative housing, ends of the extending portions being collected on the rear side of the insulative housing to form a plurality of contact pads, wherein the mating portions are coupled to the extending portions via a plurality of bending portions; and a flexible flat cable having an end portion wound around the through slot, the conductor of the end portion of the flexible flat cable being electrically coupled to the contact pads.

12. The electrical connector assembly according to claim 11, wherein the flexible flat cable is led from an edge of the rear side of the insulative housing.

13. The electrical connector assembly according to claim 11, further comprising a cover mounted on the rear side of the insulative housing.

14. The electrical connector assembly according to claim 11, wherein the contact pads have bends or bumps for contacting the conductor of the end portion of the flexible flat cable.

15. The electrical connector assembly according to claim 14, further comprising: a metal clip utilized to clamp the end portion of the flexible flat cable.

16. The electrical connector assembly according to claim 14, wherein the end portion of the flexible flat cable has two protrusions at both sides thereof, and the insulative housing has two stopping portions protrudingly formed on the rear side and corresponding to the stopping portions, and wherein the two protrusions are engaged in the two stopping portions.

17. The electrical connector assembly according to claim 14, wherein the end portion of the flexible flat cable has two protrusions at both sides thereof, and each of the two protrusion has a through hole; the insulative housing has two position pins protrudingly formed on the rear side and corresponding to the through holes, and the two position pins are inserted into the two through holes.

* * * * *